US008573517B2

(12) United States Patent
Fujino et al.

(10) Patent No.: US 8,573,517 B2
(45) Date of Patent: Nov. 5, 2013

(54) INJECTOR

(75) Inventors: Tomoki Fujino, Okazaki (JP); Jun Kondo, Nagoya (JP); Tooru Taguchi, Handa (JP); Shu Kagami, Nagoya (JP)

(73) Assignee: Denso Corporation, Kariya (JP)

( * ) Notice: Subject to any disclaimer, the term of this patent is extended or adjusted under 35 U.S.C. 154(b) by 802 days.

(21) Appl. No.: 12/764,224

(22) Filed: Apr. 21, 2010

(65) Prior Publication Data

US 2010/0264236 A1 Oct. 21, 2010

(30) Foreign Application Priority Data

Apr. 21, 2009 (JP) ..... 2009-102691

(51) Int. Cl.
*B05B 1/30* (2006.01)

(52) U.S. Cl.
USPC ..... 239/584; 239/102.2; 239/585.1; 310/311

(58) Field of Classification Search
USPC ..... 239/102.1, 102.2, 584, 585.1; 310/311; 251/129.06
See application file for complete search history.

(56) References Cited

U.S. PATENT DOCUMENTS

| | | | | |
|---|---|---|---|---|
| 4,635,849 | A * | 1/1987 | Igashira et al. | 239/102.2 |
| 4,649,886 | A * | 3/1987 | Igashira et al. | 239/584 |
| 4,720,077 | A * | 1/1988 | Minoura et al. | 239/102.2 |
| 6,663,015 | B2 * | 12/2003 | Yamada et al. | 239/102.1 |

FOREIGN PATENT DOCUMENTS

| | | |
|---|---|---|
| JP | 2007-270822 | 10/2007 |
| JP | 2008-157058 | 7/2008 |

* cited by examiner

*Primary Examiner* — Steven J Ganey
(74) *Attorney, Agent, or Firm* — Nixon & Vanderhye P.C.

(57) ABSTRACT

An injector having an injector body, in which a housing opening and a communication hale are provided, includes a supporting member fixed to an actuator, which includes a lead-wire supporting portion that supports ends of lead wires and a plate portion formed integrally with the lead-wire supporting portion. A thickness of the plate portion is smaller than that of the lead-wire supporting portion, and multiple trench portions are provided on a surface of the plate portion so that the plate portion can be easily bent. While the supporting member passes through the housing opening, the lead wires straight move. After an end portion of the supporting member contacts the communication hole, external force is applied to the end portion to bend the plate portion, and thereby the lead wires are bent while moving in the communication hole.

5 Claims, 8 Drawing Sheets

FIG. 3C
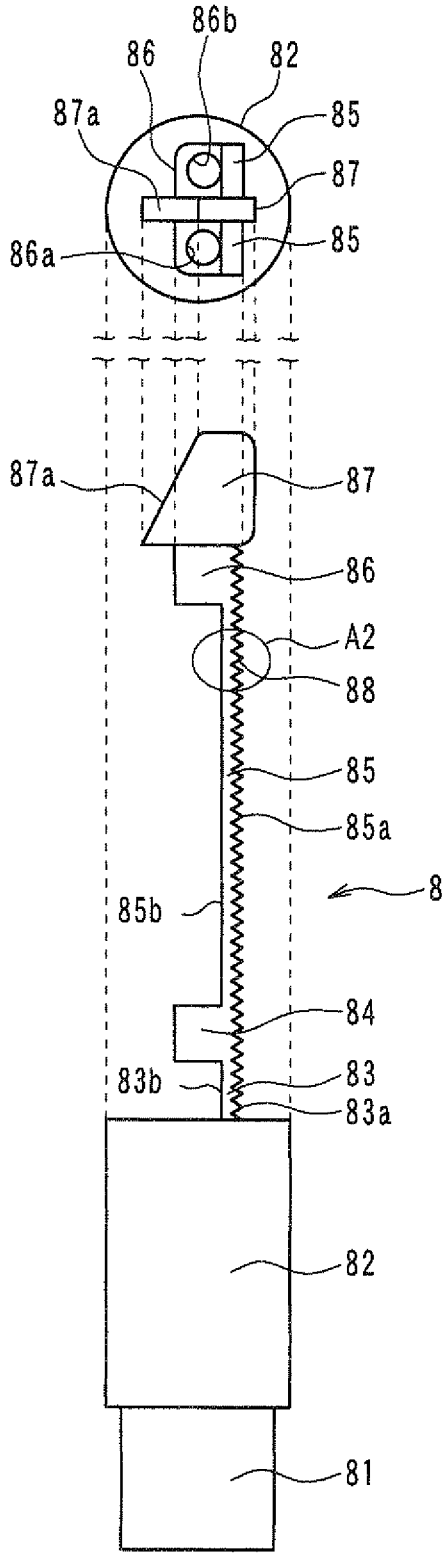
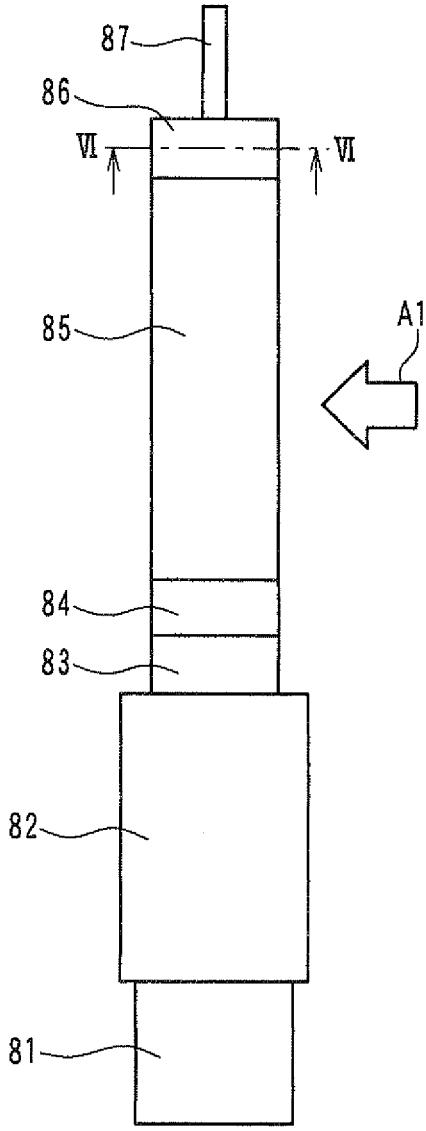
FIG. 3A
FIG. 3B

FIG. 4C
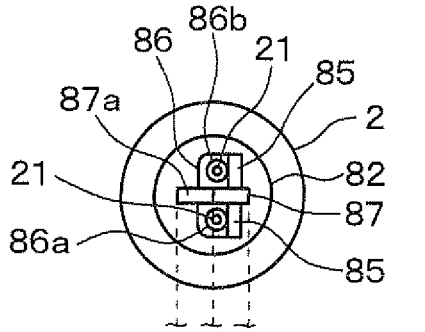
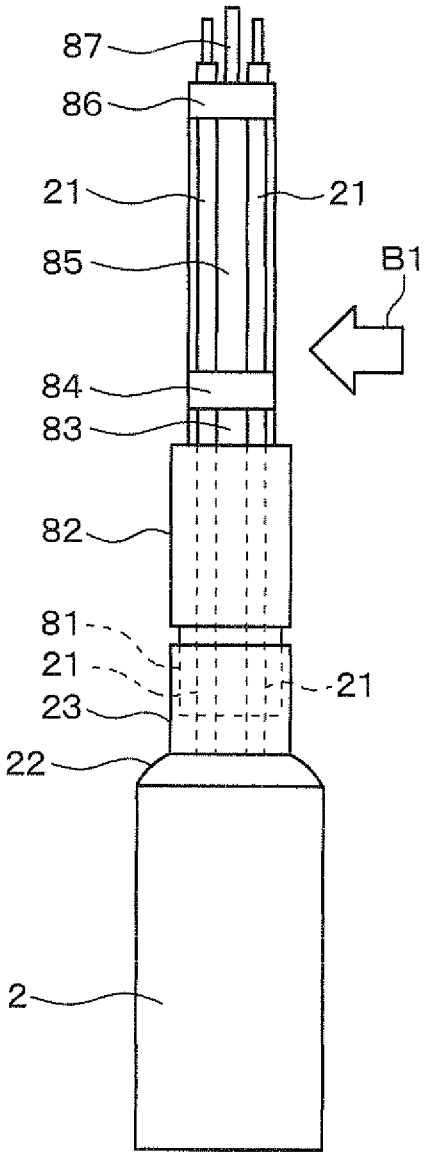
FIG. 4A
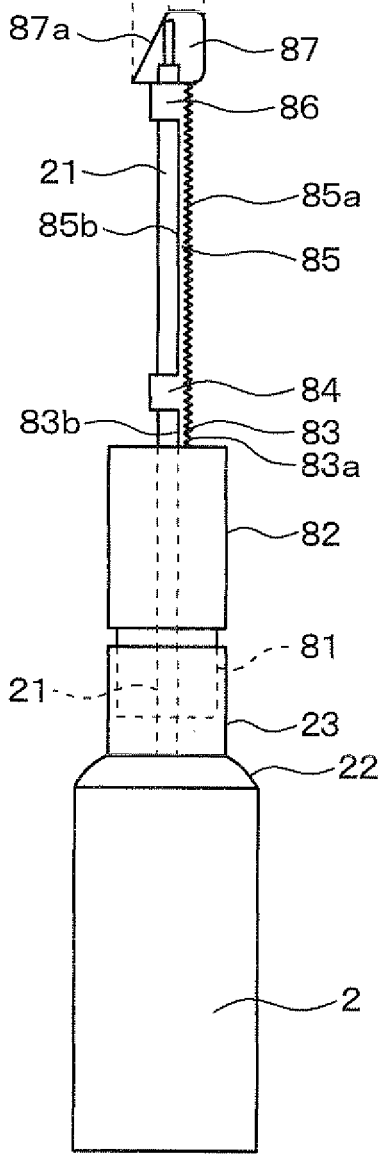
FIG. 4B

INJECTOR

CROSS REFERENCE TO RELATED APPLICATION

The present application is based on Japanese Patent Application 2009402691 filed on Apr. 21, 2009, the disclosure of which is incorporated herein by reference.

FIELD OF THE INVENTION

The present invention relates to an injector in which an opening-closing operation of a nozzle is controlled by an actuator.

BACKGROUND OF THE INVENTION

As an injector for a fuel injection device used for an internal combustion engine embedded in a vehicle, JP-A-2007-270822 and JP-A-2008-157058 disclose an injector in which an actuator is fixed to an injector body from a side of a nozzle in order to meet the needs for downsizing a device. In such an injector, one ends of two feeding lead wires are bonded to the actuator in advance. After the lead wires are inserted into a housing opening for the actuator, which is formed in the injector body, the actuator is inserted into the housing opening so that the other ends of the lead wires are taken out from a lead-wire outlet portion provided on the injector body at an opposite side of the nozzle.

In the injector of JP-A-2007-270822, the lead-wire outlet portion is formed on an upper end portion of the injector body at the opposite side of the nozzle, and the housing opening for the actuator extends straight from the side of the nozzle to the lead-wire outlet portion. In order to prevent the lead wires from being bent, a supporting member having rigidity higher than that of the lead wires is arranged on the actuator and the supporting member supports the lead wires.

A shape and a thickness of the supporting member are set so as to prevent the supporting member itself from being bent. The supporting member supports a whole part of the lead wires other than the other ends thereof. Thus, in fixing the actuator to the injector body, the lead wires can be prevented from being bent in the housing opening, and the other ends of the lead wires can be guided to the lead-wire outlet portion.

In the injector of JP-A-2008-157058, the lead-wire outlet portion is formed on a side surface of the injector body, and the housing opening for the actuator is configured such that the housing opening extends straight from the side of the nozzle, is bent at a middle portion thereof, and further extends straight from the middle portion to the lead-wire outlet portion. A guide member is arranged in the housing opening in the area between the middle portion and the lead-wire outlet portion. Further, the supporting member for preventing the lead wires from being bent is fixed to the actuator, and the supporting member is configured to be capable of being elongated and contracted in a longitudinal direction of the lead wires.

In fixing the actuator to the injector body, by supporting the whole part of the lead wires other than the other ends thereof using the supporting member in an elongate state, the lead wires can move along the housing opening without being bent. When the supporting member contacts the guide member, the supporting member is contracted and the lead wires are exposed from the supporting member, and thereby the lead wires are bent while the lead wires move toward the lead-wire outlet portion.

As described above, the supporting member of JP-A-2007-270822 supports the whole part of the lead wires other than the other ends thereof, and the entire supporting member cannot be bent. Thus, the supporting member of JP-A-2007-270822 cannot be applied to the injector of JP-A-2008-157058, in which the housing opening provided in the injector body is not straight but bent at the middle portion.

In contrast, the injector of JP-A-2008-157058, in which the housing opening provided in the injector body is bent at the middle portion thereof, is configured such that in fixing the actuator to the injector body, the lead wires can be easily bent after the lead wires move along the housing opening without being bent. However, the number of components required for the injector may be increased. That is, in order to move only the lead wires toward the lead-wire outlet portion from the middle portion, the guide member is necessary for guiding the lead wires to the lead-wire outlet portion other than the supporting member that is fixed to the actuator. Further, in order that the supporting member is configured to be capable of being elongated and contracted, the supporting member is constructed of multiple components such as a fixed supporting member that is fixed to the actuator, and a movable supporting member that can relatively move with respect to the fixed supporting member. Therefore, the number of components necessary for guiding the lead wires to the lead-wire outlet portion may be increased.

SUMMARY OF THE INVENTION

In view of the above points, it is an object of the present invention to provide an injector having a configuration that lead wires can be bent after the lead wires move along an injector body without being bent in fixing an actuator to the injector body, which can decrease the number of components for guiding the lead wires to a lead-wire outlet portion.

According to one aspect of the present invention, an injector includes a cylindrical injector body having therein a housing opening; an actuator housed in the housing opening; two feeding lead wires, one ends of which being electrically connected to the actuator; a nozzle configured to open and close in accordance with an energization state of the actuator and to inject a fuel when the nozzle is opened; a lead-wire outlet portion that opens on a side surface of the injector body; a communication hole that is provided in the injector body, the lead-wire outlet portion communicating with the housing opening via the communication hole; and a supporting member that is fixed to the actuator and supports the lead wires. The housing opening extends straight from an end of the injector body at a side of the nozzle toward an opposite side of the nozzle. The communication hole extends in a direction bent by a predetermined angle with respect to an extending direction of the housing opening, The supporting member is configured to guide the other ends of the lead wires to the lead-wire outlet portion when the actuator is inserted into the housing opening. The supporting member includes a lead-wire supporting portion and a plate portion formed integrally with the lead-wire supporting portion. The lead-wire supporting portion directly supports the other ends of the lead wires and the plate portion does not support the lead wires. The plate portion has a first surface and a second surface that is opposite from the first surface. The first surface faces a side of the lead-wire outlet portion and the lead wires are located on the second surface. The plate portion is configured such that a shape thereof is maintained in a normal state, in which an external force to bend the supporting member to the side of the lead-wire outlet portion is not applied to an end portion of the supporting member, and that the supporting member is bent with the first surface facing inwardly when the external force is applied to the supporting member.

By configuring the supporting member in this manner, in the normal state, in which the external force is not applied to the supporting member, the supporting member can support the lead wires with the lead wires prevented from being bent. When the external force is applied to the supporting member, the supporting member can support the lead wires with the lead wires being bent.

Thus, in fixing the actuator to the injector body by inserting the actuator into the housing opening, while the supporting member passes through the housing opening, the supporting member is in the normal state, and thereby the lead wires can move without being bent. While the supporting member passes through the communication hole, after the end portion of the supporting member contacts an inner wall of the communication hole, the external force for bending the supporting member toward the lead-wire outlet portion is applied to the end portion of the supporting member from the inner wall of the communication hole, and thereby the plate portion is bent. Therefore, the lead wires are bent while moving in the communication hole.

According to the above configuration, the supporting member moves along the communication hole. Compared with the configuration described in JP-A-2008-157058, in which only the lead wires pass through the communication hole, the guide member for guiding the lead wires to the lead-wire outlet portion needs not to be provided in the injector body. Further, because the lead-wire supporting portion and the plate portion which configures the supporting member are integrally formed in the above configuration, the number of components for the supporting member can be decreased compared with the supporting member of JP-A-2008-157058. Therefore, the number of components for guiding the lead wires to the lead-wire outlet portion can be decreased compared with the injector of JP-A-2008-157058.

BRIEF DESCRIPTION OF THE DRAWINGS

The above and other objects, features and advantages of the present invention will become more apparent from the following detailed description made with reference to the accompanying drawings. In the drawings:

FIGS. 3A to 3C are a front view, a side view, and a top view showing a supporting member;

FIGS. 4A to 4C are a front view, a side view, and a top view showing the supporting member equipped with a piezo actuator;

DETAILED DESCRIPTION OF THE PREFERRED EMBODIMENTS

Embodiment

Figure 1:
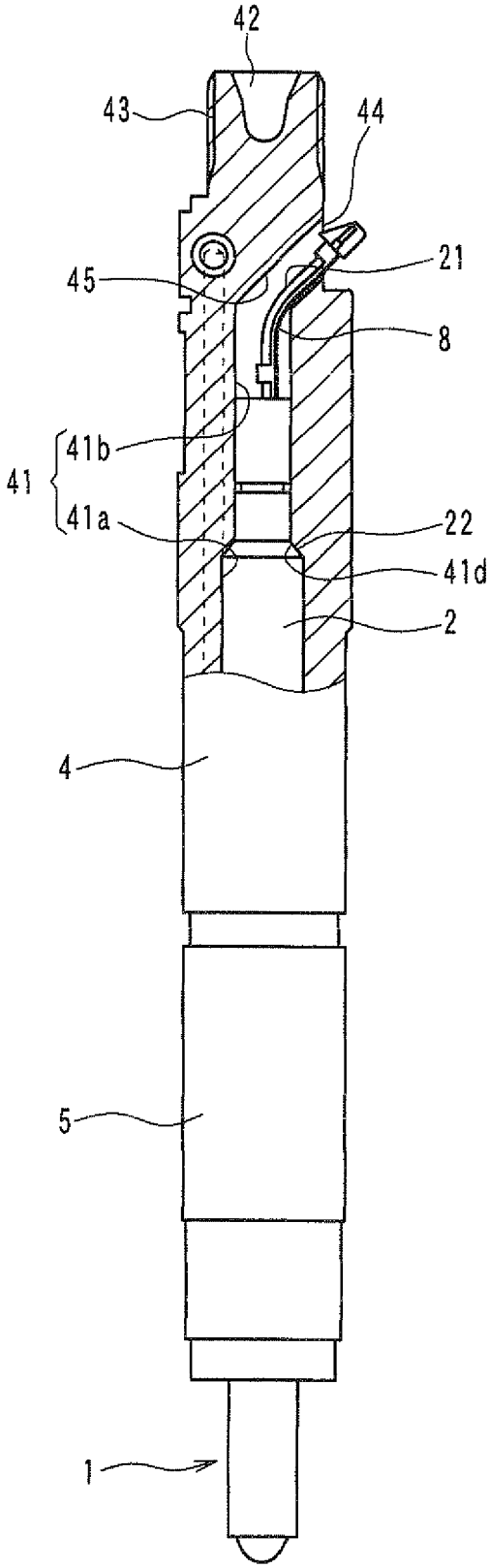
FIG. 1 is a partial cross-sectional view showing an injector for a fuel injection device according to an embodiment of the present invention.
Figure 2:
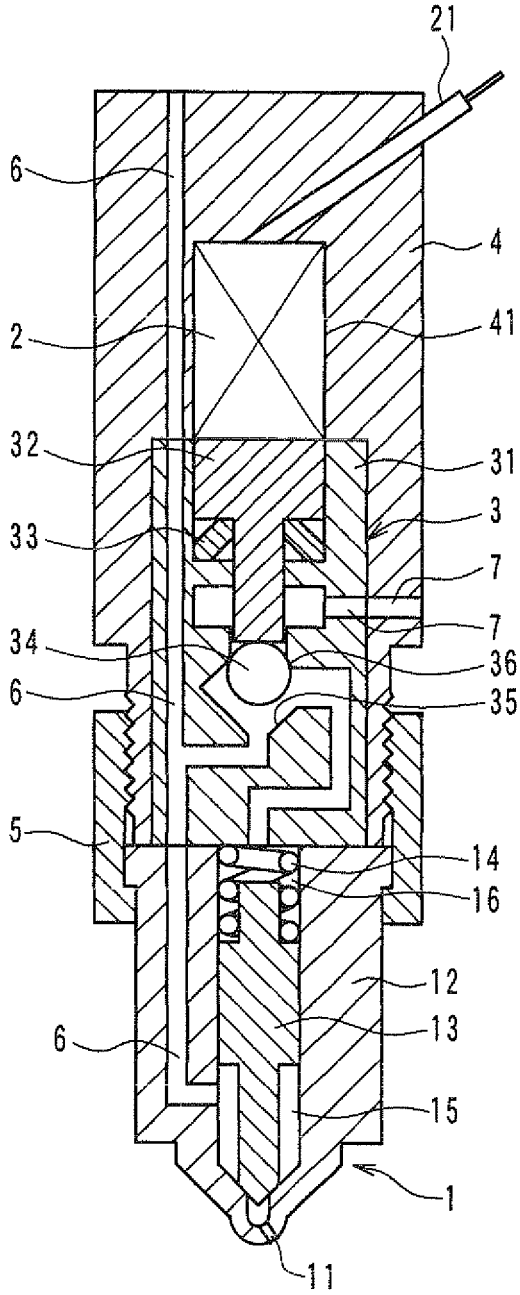
FIG. 2 is a cross-sectional view showing a configuration inside the injector of FIG. 1.

FIG. 1 is a partial cross-sectional view showing an injector for a fuel injection device according to an embodiment of the present invention, and FIG. 2 is a cross-sectional view showing a configuration inside the injector of FIG. 1.

Firstly, a basic configuration and operation of an injector will be described based on FIG. 2. The injector injects high pressure fuel stored in a common-rail into a cylinder of a diesel internal combustion engine. As shown in FIG. 2, the injector has a nozzle 1, from which fuel is injected when a valve is opened, a piezo actuator 2 that is elongated and contracted by charge-discharge of an electric charge, and a back-pressure control portion 3 that is driven by the piezo actuator 2 to control a back pressure of the nozzle 1.

The nozzle 1 includes a nozzle body 12 having a nozzle opening 11, a needle 13 configured to be attached to and detached from a valve seat of the nozzle body 12 to open and close the nozzle opening 11, and a spring 14 for biasing the needle 13 in a valve-closing direction.

Although not shown, the piezo actuator 2 is configured such that laminated multiple piezoelectric elements are housed in a cylindrical housing made of metal. One ends of two feeding lead wires 21 are connected to the piezo actuator 2. The one ends of the two feeding lead wires 21 are electrically connected to the piezoelectric elements, and the other ends of the two feeding lead wires 21 are electrically connected to a positive electrode terminal and a negative electrode terminal of a power source (not shown), respectively. The two lead wires 21 are supported by a supporting member 8 as a feature of the present invention. The supporting member 8 will hereinafter be described in detail.

A piston 32 that moves in accordance with the elongation and the contraction of the piezo actuator 2, a disc spring 33 that biases the piston 32 toward the piezo actuator 2, and a spherical valve element 34 driven by the piston 32 are housed in a valve body 31 of the back-pressure control portion 3. Although the valve body 31 is shown as one component in FIG. 2, the valve body 31 is in fact divided into multiple pieces.

The injector has an injector body 4 having a substantially cylindrical shape, and a cylindrical housing opening 41 extending in an axis direction of the injector with a step portion is formed in the injector body 4 at the center portion in a radial direction thereof. The piezo actuator 2 and the back-pressure control portion 3 are housed in the housing opening 41. A retainer 5 having a substantially cylindrical shape is fixed to the injector body 4 by screwing so that the nozzle 1 is supported at an end portion of the injector body 4.

A high-pressure passage 6, into which high pressure fuel is always supplied from the common-rail, is formed in the nozzle body 12, the injector body 4 and the valve body 31. A low-pressure passage 7 connected to a fuel tank (not shown) is formed in the injector body 4 and the valve body 31. The nozzle body 12, the injector body 4 and the valve body 31 are made of metal.

A high-pressure chamber 15 is formed between an outer periphery surface of the needle 13 at a side of the nozzle opening 11 and an inner periphery surface of the nozzle body 12. The high-pressure chamber 15 is configured to communicate the nozzle opening 11 when the needle 13 is displaced in a valve-opening direction. The high pressure fuel is always supplied to the high-pressure chamber 15 through the high-pressure passage 6. A back-pressure chamber 16 is formed on the needle 13 at an opposite side of the nozzle opening 11. The above-described spring 14 is arranged in the back-pressure chamber 16.

The valve body 31 has a high-pressure seat surface 35 and a low-pressure seat surface 36. The high-pressure seat surface 35 is arranged in a passage through which the high-pressure passage 6 in the valve body 31 communicates with the back-pressure chamber 16 of the nozzle 1, and the low-pressure seat surface 36 is arranged in a passage through which the low-pressure passage 7 in the valve body 31 communicates with the back-pressure chamber 16 of the nozzle 1. The above-described valve element 34 is arranged between the high-pressure seat surface 35 and the low-pressure seat surface 36.

According to the above configuration, the nozzle 1 is opened or closed in accordance with an energization state of the piezo actuator 2. In particular, when the piezo actuator 2 is contracted, as shown in FIG. 2, the valve element 34 contacts the low-pressure seat surface 36 and the back-pressure chamber 16 is connected to the high-pressure passage 6 so that a high fuel pressure is introduced into the back-pressure chamber 16. Thus, the needle 13 is biased in the valve-closing direction by the fuel pressure in the back-pressure chamber 16 and the spring 14, and thereby the nozzle opening 11 is closed.

In contrast, when the piezo actuator 2 is energized to be elongated, the valve element 34 contacts the high-pressure seat surface 35 and the back-pressure chamber 16 is connected to the low-pressure passage 7 so that a fuel pressure in the back-pressure chamber 16 becomes low. Thus, the needle 13 is biased in the valve-opening direction by the fuel pressure in the high-pressure chamber 15, and thereby the nozzle opening 11 is opened and the fuel is injected into the cylinder of the internal combustion engine from the nozzle opening 11.

Next, a specific configuration of the injector of the present embodiment will be described. As shown in FIG. 1, an inlet portion 42 for the high pressure fuel and a male screw portion 43 for connecting a pipe are formed on the injector body 4 at an end portion that is an opposite side of the nozzle 1, i.e., an upper end portion in FIG. 1. By connecting a pipe for the high pressure fuel to the upper end portion, the high pressure fuel can be supplied into the injector from the common-rail.

As described above, the cylindrical housing opening 41 extending in the axis direction of the injector is formed in the injector body 4 at the center portion in the radial direction thereof. The housing opening 41 includes a first housing opening 41*a* and a second housing opening 41*b*.

One end of the first housing opening 41*a* opens on an end surface of the injector body 4 at a side of the nozzle 1. The first housing opening 41*a* extends toward the opposite side of the nozzle 1 from the end surface at the side of the nozzle 1 of the injector body 4, that is, extends upwardly from a lower end surface in FIG. 1. A diameter of the second housing opening 41*b* is smaller than that of the first housing opening 41*a*. The second housing opening 41*b* extends toward the opposite side of the nozzle 1 of the injector body 4 from an end portion of the first housing opening 41*a* at the opposite side of the nozzle 1. The first and second housing openings 41*a*, 41*b* are coaxially-arranged.

Figure 7:
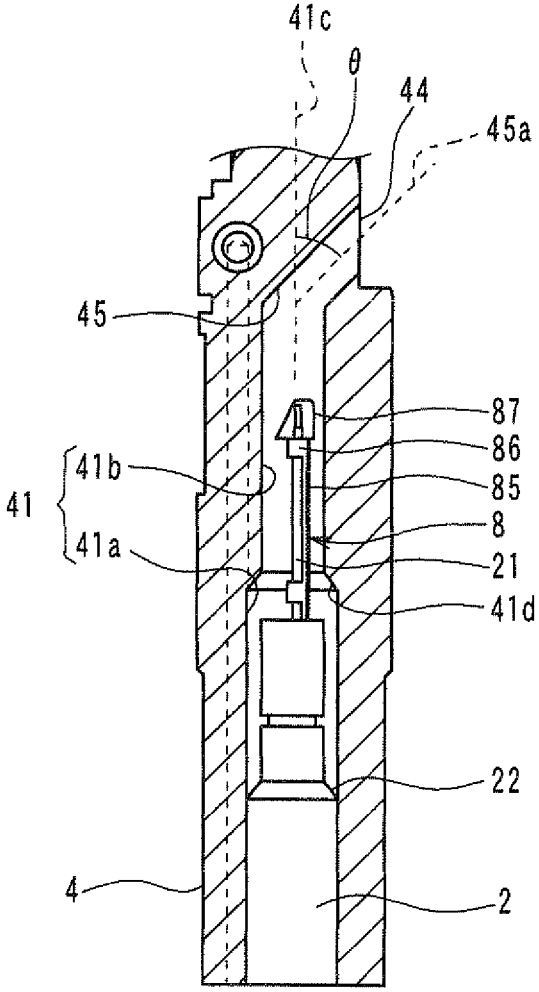
FIG. 7 is a cross-sectional view showing a process for fixing the piezo actuator to an injector body.

The injector body 4 has a lead-wire outlet portion 44 on a side surface thereof at the opposite side of the nozzle 1 and therein a cylindrical communication hole 45. The housing opening 41 communicates with the lead-wire outlet portion 44 via the communication hole 45. The communication hole 45 extends linearly in a direction bent by a predetermined angle with respect to an extending direction of the housing opening 41. In particular, as shown in FIG. 7 described below, an angle θ made by a line 41*c*, which is obtained by extending an axis line of the housing opening 41 toward a side of an upper end portion of the injector body 4, and an axis line 45*a* of the communication hole 45 is an acute angle.

The piezo actuator 2 is housed in the first housing opening 41*a*, and the lead wires 21 and the supporting member 8 are housed in the second housing opening 41*b* and the communication hole 45. A tapered seat surface 22 formed in the housing of the piezo actuator 2 contacts a step portion 41*d* of the first housing opening 41*a* and the second housing opening 41*b* so that the piezo actuator 2 is positioned and fixed to the injector body 4.

The supporting member 8 supports the lead wires 21 extending from the piezo actuator 2, and guides the other ends of the lead wires 21 to the lead-wire outlet portion 44 in inserting the piezo actuator 2 into the housing opening 41. In a state where the piezo actuator 2 is fitted in the injector body 4, the lead wires 21 swing to be rubbed against the injector body 4, and thereby the lead wires 21 may be worn away. The supporting member 8 holds the lead wires 21 to prevent the lead wires 21 from being worn away.

FIGS. 3A to 3C show only the supporting member 8, and FIGS. 4A to 4C show the supporting member 8 equipped with the piezo actuator 2. FIGS. 3A and 4A are front views of the supporting member 8, FIGS. 3B and 4B are side views viewed from directions shown by the arrows A1 and B1 in FIGS. 3A and 3B, and FIGS. 3C and 4C are top views of the supporting member 8 shown in FIGS. 3B and 4B.

In particular, as shown in FIGS. 3A and 3B, the supporting member 8 includes a fixing portion 81, a cylindrical portion 82, a first plate portion 83, a first lead-wire supporting portion 84, a second plate portion 85, a second lead-wire supporting portion 86 and an end portion 87, which are arranged in this order from a lower side to an upper side in FIGS. 3A and 3B and are formed integrally using resin such as polyamide series synthetic fiber, for example.

The fixing portion 81 is a cylindrical portion located at one end of the supporting member 8 and configured to be fixed to the piezo actuator 2. As shown in FIGS. 4A and 4B, the fixing portion 81 is press-fitted into a cylindrical tubular portion 23 arranged at an end portion of the piezo actuator 2 so that the supporting member 8 is fixed to the piezo actuator 2. The fixing portion 81 has a through-hole into which the two lead wires 21 are inserted.

The cylindrical portion 82 is a portion grasped by a working robot in the press-fitting of the fixing portion 81. For example, the cylindrical portion 82 has a cylindrical shape having a diameter larger than that of the fixing portion 81. The cylindrical portion 82 has a through-hole into which the two lead wires 21 are inserted, and directly supports the lead wires 21.

As shown in FIGS. 3B and 4B, the first and second plate portions 83, 85 are thin plate portions. The first plate portion 83 has a first surface 83*a* and a second surface 83*b* opposite from the first surface 83*a*, and the second plate portion 85 has a first surface 85*a* and a second surface 85*b* opposite from the first surface 85*a*. As shown in FIG. 1, in the state where the piezo actuator 2 is fitted in the injector body 4, the supporting member 8 is bent toward the lead-wire outlet portion 44. The supporting member 8 is bent with the first surfaces 83*a*, 85*a* of the first and second plate portions 83, 85 facing inwardly. The first surfaces 83*a*, 85*a* have multiple trench portions 88 such that the first and second plate portions 83, 85 can be easily bent, that is, flexibility of the plate portions 83, 85 is increased.

In contrast, in the state where the piezo actuator 2 is fitted in the injector body 4, the supporting member 8 is bent with the second surfaces 83*b*, 85*b* of the first and second plate portions 83, 85 facing outwardly. When the supporting member 8 supports the lead wires 21, the lead wires 21 are located on and contact the second surfaces 83*b*, 85*b*. The second surfaces 83*b*, 85*b* are flat surfaces.

Figure 5:
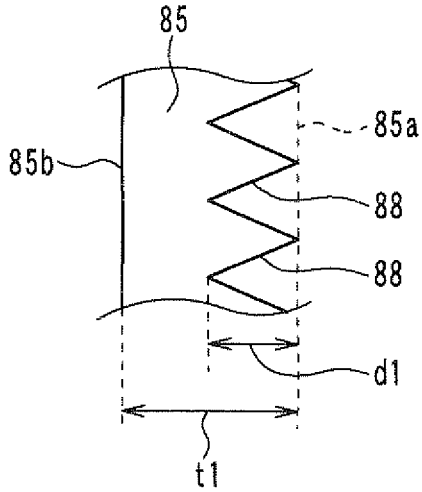
FIG. 5 is an enlarged view showing an area A2 of FIG. 3B.

FIG. 5 shows the enlarged view of the area A2 of FIG. 3B. The one trench portion 88 provided on the first surfaces 83*a*, 85*a* of the first and second plate portions 83, 85 has an inverted triangle shape having an acute bottom. The trench portion 88 extends in a direction perpendicular to a longitudinal direction of the lead wires 21, i.e., in a direction perpendicular to the paper surface of each of FIGS. 3A and 4A. The trench portions 88 having such a shape are continuously arranged along the longitudinal direction of the lead wires 21. Thus, the first surfaces 83*a*, 85*a* have a saw-tooth shape.

The first and second plate portions 83, 85 are straight in a normal state, in which external force is not applied thereto. A thickness of each of the first and second plate portions 83, 85 and a depth of the trench portion 88 are set such that the first and second plate portions 83, 85 can be bent when external force to bend the supporting member 8 is applied thereto. The thickness of each of the first and second plate portions 83, 85 is smaller than that of each of the first and second lead-wire supporting portions 84, 86. For example, in case of forming the first and second plate portions 83, 85 using nylon, a thickness t1 of each of the first and second plate portions 83, 85 is about 1 mm, and a depth d1 of the trench portion 88 is half of the thickness t1, i.e., about 0.5 mm. The thickness t1 indicates a thickness of each of the first and second plate portions 83, 85 in a direction perpendicular to both the first surfaces 83*a*, 85*a* and the second surfaces 83*b*, 85*b*.

A dimension of the second plate portion 85 in the longitudinal direction of the lead wires 21 is set to be larger than a dimension between the lead-wire outlet portion 44 of the communication hole 45 and the housing opening 41, i.e., a dimension of the communication hole 45.

The first and second lead-wire supporting portions 84, 86 directly support the two lead wires 21. As shown in FIGS. 4A and 4B, in the area between the cylindrical portion 82 and the end portion 87, the first lead-wire supporting portion 84 is located at a side of the actuator 2, and the second lead-wire supporting portion 86 is located adjacent to the end portion 87, that is, at a side of the other ends of the lead wires 21.

Figure 6:
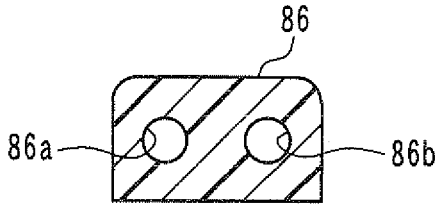
FIG. 6 is a cross-sectional view taken along a line VI-VI of FIG. 3A.

FIG. 6 shows the cross-sectional view taken along the line VI-VI of FIG. 3A. As shown in FIG. 6, the second lead-wire supporting portion 86 has two through-holes 86*a*, 86*b*. As shown in FIG. 4C, the lead wires 21 are inserted in the through-holes 86*a*, 86*b*, respectively, and thereby the lead wires 21 are directly supported by the second lead-wire supporting portion 86. Similarly, the first lead-wire supporting portion 84 has two through-holes.

Unlike the first and second lead wire supporting portions 84, 86, the first and second plate portions 83, 85 do not have a through-hole, a trench portion or the like for directly supporting the lead wires 21. That is, the first and second plate portions 83, 85 do not directly support the two lead wires 21. Thus, the supporting member 8 of the present embodiment is configured such that a part of the lead wires 21 other than the other ends thereof not the whole part is supported by the first and second lead-wire supporting portions 84, 86.

The end portion 87 is configured to separate the other ends of the two lead wires 21. In particular, as shown in FIGS. 4A to 4C, the end portion 87 has a plate shape, and is arranged to be parallel to the two lead wires 21 and perpendicular to the second plate portion 85. Further, the end portion 87 has an inclined portion 87*a* that is inclined with respect to an extending direction of the lead wires 21 such that the end portion 87 can be moved easily along an inner wall of the communication hole 45.

Next, the fixing of the piezo actuator 2 to the injector body 4 will be described.

First, as shown in FIGS. 4A to 4C, the supporting member 8 is fixed to the actuator 2. In particular, the supporting member 8 having the configuration shown in FIGS. 3A to 3C and the actuator 2, to which the one ends of the lead wires 21 are bonded, are prepared. Then, the other ends of the lead wires 21 are inserted into the fixing portion 81, the cylindrical portion 82, the first lead-wire supporting portion 84 and the second lead-wire supporting portion 86 in this order, and the fixing portion 81 is press-fitted into the actuator 2.

Figure 8:
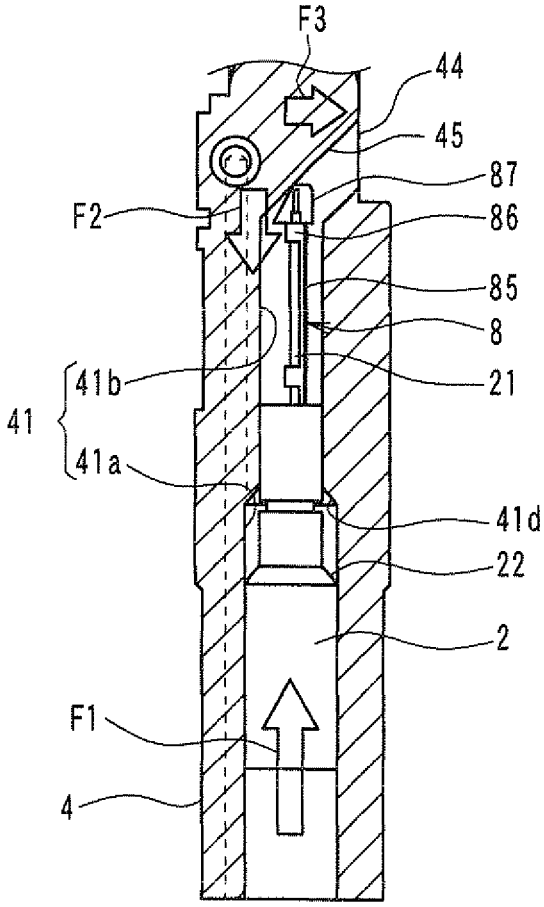
FIG. 8 is a cross-sectional view showing the process for fixing the piezo actuator to the injector body following FIG. 7.
Figure 9:
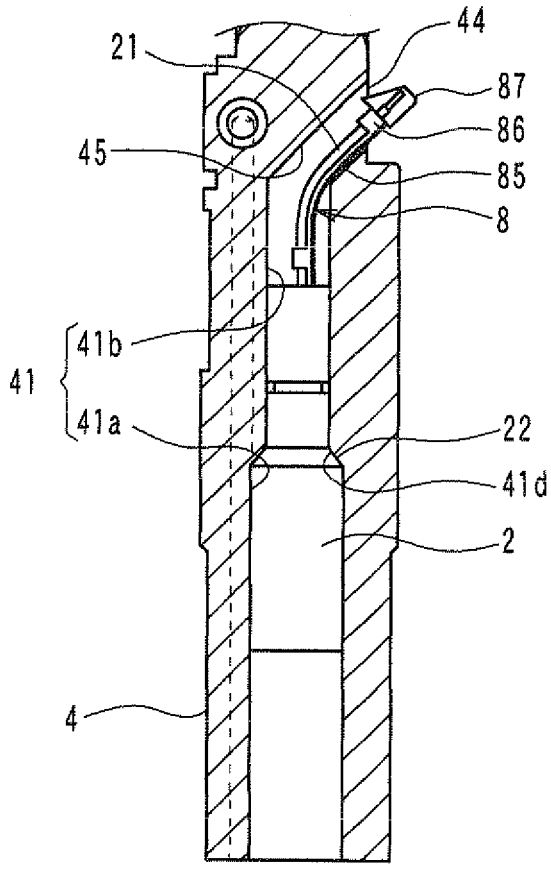
FIG. 9 is a cross-sectional view showing the process for fixing the piezo actuator to the injector body following FIG. 8.

At this time, as shown in FIG. 4B, the lead wires 21 move over the flat second surfaces 83*b*, 85*b* among the first surfaces 83*a*, 85*a* and the second surfaces 83*b*, 85*b*. Thus, the lead wires 21 can move smoothly without being rubbed against something, After that, the piezo actuator 2, with which the supporting member 8 is equipped, is fixed to the injector body 4. FIGS. 7 to 9 show the states in fixing the piezo actuator 2 to the injector body 4.

As shown in FIG. 7, the other ends of the lead wires 21 and the end portion 87 are inserted into the housing opening 41 from the side of the nozzle 1 of the injector body 4, and the piezo actuator 2 is pressed and inserted into the housing opening 41. At this time, the first surfaces 83*a*, 85*a* are set to face a side of the lead-wire outlet portion 44.

In the supporting member 8, the thickness t1 of each of the first and second plate portions 83, 85 is set as described above, and the multiple trench portions 88 are provided on the first surfaces 83*a*, 85*a* of the first and second plate portions 83, 85. Therefore, the first and second plate portions 83, 85 can maintain the straight shape in the normal state, in which external force is not applied to the end portion 87, and the first and second plate portions 83, 85 can be bent easily when external force to bend the supporting member 8 is applied to the end portion 87.

In the normal state, the supporting member 8 can support the lead wires 21 with the lead wires 21 prevented from being bent. In contrast, when the external force is applied to the supporting member 8, the supporting member 8 can support the lead wires 21 with the lead wires 21 being bent.

Thus, as shown in FIG. 7, the end portion 87 of the supporting member 8 can move in the housing opening 41 without contacting something until the end portion 87 reaches the communication hole 45. External force other than the force for pressing the supporting member 8 into the injector body 4 is not applied to the supporting member 8, and thereby the supporting member 8 is in the normal state. Therefore, while the end portion 87 passes through the housing opening 41, the lead wires 21 can move without being bent.

As shown in FIG. 8, after the end portion 87 reaches the communication hole 45 and contacts the inner wall of the communication hole 45, if the piezo actuator 2 is further pressed into the housing opening 41, external force is applied to the end portion 87 from the inner wall of the communication hole 45. The external force can be separated into force F2 and force F3. A direction of the force F2 is opposite from that of force F1 for pressing the piezo actuator 2. A direction of the force F3 is perpendicular to a pressing direction of the piezo actuator 2, and the force F3 is applied toward the lead-wire outlet portion 44. That is, the forces F2 and F3 for bending the supporting member 8 toward the lead-wire outlet portion 44 are applied to the end portion 87. Therefore, while the end portion 87 passes through the communication hole 45, the end portion 87 moves along the inner wall of the communication hole 45 with the first and second plate portions 83, 85 bending toward the lead-wire outlet portion 44, and thereby the lead wires 21 are bent while moving in the communication hole 45. At this time, the supporting member 8 is bent with the first surfaces 83*a*, 85*a* of the first and second plate portions 83, 85 facing inwardly.

After that, as shown in FIG. 9, the piezo actuator 2 reaches a position, at which the seat surface 22 of the piezo actuator 2 contacts the step portion 41*d* of the first housing opening 41*a* and the second housing opening 41*b*, and the other ends of the lead wires 21 are taken out from the lead-wire outlet portion 44, and thereby inserting of the piezo actuator 2 into the injector body 4 is finished.

After the fixing of the piezo actuator 2 to the injector body 4 is finished as described above, the other ends of the two lead wires 21 are bonded to the positive electrode terminal and the negative electrode terminal respectively and a connector housing is integrally formed on the end portion 87 by resin molding so that a connector is formed (not shown in the drawings). Further, the back-pressure control portion 3 is housed in the injector body 4 and the retainer 5 is fixed to the injector body 4 by screwing to support the nozzle 1 so that the injector shown in FIG. 1 is completed.

As described above, in the present embodiment, the lead wires 21 and the supporting member 8 are bent while moving along the communication hole 45. Compared with the conventional injector of JP-A-2008-157058, in which only the lead wires pass through the communication hole, a guide member for guiding the lead wires 21 into the injector body 4 is unnecessary in the present embodiment. Further, because the supporting member of JP-A-2008-157058 is configured to be capable of being elongated and contracted, the supporting member needs to be constructed of multiple components. In contrast, the supporting member 8 of the present embodiment is formed integrally using resin, that is, the supporting member 8 is constructed of a single component. Thus, the number of components for the supporting member 8 of the present embodiment can be decreased compared with the supporting member of JP-A-2008-157058, Therefore, according to the present embodiment, the number of components for guiding the lead wires 21 to the lead-wire outlet portion 44 can be decreased compared with the injector of JP-A-2008-157058.

Other Embodiments (1) In the above-described embodiment, the supporting member 8 includes the first and second plate portions 83, 85. However, the first plate portion 83 may be replaced with a lead-wire supporting portion. Further, the first lead-wire supporting portion 84 may be replaced with a plate portion, and the first and second plate portions 83, 85 may be continuously formed.

That is, the supporting member 8 may have any configuration as long as the supporting member 8 has at least the lead-wire supporting portion 86 for supporting the other ends of the lead wires 21 and the plate portion 85 connected thereto, and the dimension of the plate portion 85 in the longitudinal direction of the lead wires 21 is set to be larger than that of the communication hole 45 such that the supporting member 8 can be bent while moving along the communication hole 45.

(2) In the above-described embodiment, the trench portion 88 has the inverted triangle shape with the acute bottom. However, the trench portion 88 may have another shape. For example, the trench portion 88 may have a circular bottom. Further, in the above-described embodiment, the multiple trench portions 88 are continuously arranged. However, the trench portions 88 may be arranged with the adjacent trench portions 88 spaced therebetween. Moreover, only one trench portion 88 may be arranged.

(3) In the above-described embodiment, each of the first and second plate portions 83, 85 has a flat plate shape that is straight in the normal state. However, each of the plate portions 83, 85 may have another shape and be bent somewhat in the normal state as long as the plate portions 83, 85 can maintain the shapes thereof and the lead wires 21 can be supported by the supporting member 8 without being bent.

(4) In the above-described embodiment, the multiple trench portions 88 are provided only on the first surfaces 83*a*, 85*a*, and the second surfaces 83*b*, 85*b* are flat surfaces. However, the trench portions 88 may be provided only on the second surfaces 83*b*, 85*b*, and the first surfaces 83*a*, 85*a* may be flat surfaces, or the trench portions 88 may be provided on both the first surfaces 83*a*, 85*a* and the second surfaces 83*b*, 85*b*. In this manner, by providing the trench portions 88 on at least one of the first surfaces 83*a*, 85*a*, and the second surfaces 83*b*, 85*b*, the first and second plate portions 83, 85 can be easily bent.

In terms of the ease of fixing the supporting member 8 to the actuator 2, as shown in the above-described embodiment, it is preferable that the trench portions 88 are provided on the first surfaces 83*a*, 85*a*, and the second surfaces 83*b*, 85*b* are flat surfaces. That is because the lead wires 21 may be caught on the trench portions and cannot be fixed to the supporting member 8 smoothly when the lead wires 21 are supported by the supporting member 8 if the trench portions 88 are provided on the second surfaces 83*b*, 85*b*.

(5) In the above-described embodiment, the trench portions 88 are provided on the first and second plate portions 83, 85 such that the plate portions 83, 85 can be easily bent However, if the thickness t1 is set such that the plate portions 83, 85 can be easily bent, the trench portions 88 may not be provided.

In the above-described embodiment, the thickness t1 of each of the plate portions 83, 85 is set to be smaller than that of each of the first and second lead-wire supporting portions 84, 86. However, if the supporting member 8 can be bent when the external force is applied thereto by providing the trench portions 88, the thickness t1 of each of the plate portions 83, 85 may be equal to or larger than that of each of the lead-wire supporting portions 84, 86.

In terms of the ease of bending the plate portions 83, 85 when the external force is applied thereto, as shown in the above-described embodiment, it is preferable that the thickness t1 of each of the plate portions 83, 85 is set to be smaller than that of each of the lead-wire supporting portions 84, 86, and that the trench portions 88 are provided on the plate portions 83, 85.

(6) In the above-described embodiment, each of the first and second lead-wire supporting portions 84, 86 has the two through-holes. However, the lead-wire supporting portions 84, 86 may have trench portions in place of the through-holes. That is, as long as the lead-wire supporting portions 84, 86 have supporting portions such as the through-holes and the trench portions which can directly support the lead wires 21, the supporting portions may have any configuration.

(7) In the above-described embodiment, the fixing portion 81 of the supporting member 8 is press-fitted into the piezo actuator 2. However, the supporting member 8 may be fixed to the piezo actuator 2 by another method, for example, a method described below. The fixing portion 81 is inserted into the cylindrical tubular portion 23 arranged on the piezo actuator 2, and an end portion of the tubular portion 23 is caulked so that the supporting member 8 is fixed to the piezo actuator 2.

In the above-described embodiment, in order to control the back pressure of the nozzle 1, the back-pressure control portion 3 is driven by the piezo actuator 2. However, in order to control the back pressure of the nozzle 1, the back-pressure control portion 3 may be driven by an electromagnetic solenoid as an actuator.

(9) The above-described embodiments may be combined in various ways.

While the invention has been described with reference to preferred embodiments thereof, it is to be understood that the invention is not limited to the preferred embodiments and constructions. The invention is intended to cover various modification and equivalent arrangements. In addition, while the various combinations and configurations, which are preferred, other combinations and configurations, including more, less or only a single element, are also within the spirit and scope of the invention.

What is claimed is:

1. An injector comprising:

a cylindrical injector body having therein a housing opening;

an actuator housed in the housing opening;

two feeding lead wires, one ends of which being electrically connected to the actuator;

a nozzle configured to open and close in accordance with an energization state of the actuator and to inject a fuel when the nozzle is opened;

a lead-wire outlet portion that opens on a side surface of the injector body;

a communication hole that is provided in the injector body, the lead-wire outlet portion communicating with the housing opening via the communication hole; and a supporting member that is fixed to the actuator and supports the lead wires, wherein the housing opening extends straight from an end of the injector body at a side of the nozzle toward an opposite side of the nozzle, the communication hole extends in a direction bent by a predetermined angle with respect to an extending direction of the housing opening, the supporting member is configured to guide the other ends of the lead wires to the lead-wire outlet portion when the actuator is inserted into the housing opening, the supporting member includes a lead-wire supporting portion and a plate portion formed integrally with the lead-wire supporting portion, the lead-wire supporting portion directly supports the other ends of the lead wires and the plate portion does not support the lead wires, the plate portion has a first surface and a second surface that is opposite from the first surface, the first surface faces a side of the lead-wire outlet portion and the lead wires are located on the second surface, the plate portion is configured such that a shape thereof is maintained in a normal state, in which an external force to bend the supporting member to the side of the lead-wire outlet portion is not applied to an end portion of the supporting member, and that the supporting member is bent with the first surface facing inwardly when the external force is applied to the supporting member, and a thickness of the plate portion in a direction perpendicular to both the first surface and the second surface is smaller than that of the lead-wire supporting portion.

2. An injector comprising:

a cylindrical injector body having therein a housing opening;

an actuator housed in the housing opening;

two feeding lead wires, one ends of which being electrically connected to the actuator;

a nozzle configured to open and close in accordance with an energization state of the actuator and to inject a fuel when the nozzle is opened;

a lead-wire outlet portion that opens on a side surface of the injector body;

a communication hole that is provided in the injector body, the lead-wire outlet portion communicating with the housing opening via the communication hole; and a supporting member that is fixed to the actuator and supports the lead wires, wherein the housing opening extends straight from an end of the injector body at a side of the nozzle toward an opposite side of the nozzle, the communication hole extends in a direction bent by a predetermined angle with respect to an extending direction of the housing opening, the supporting member is configured to guide the other ends of the lead wires to the lead-wire outlet portion when the actuator is inserted into the housing opening, the supporting member includes a lead-wire supporting portion and a plate portion formed integrally with the lead-wire supporting portion, the lead-wire supporting portion directly supports the other ends of the lead wires and the plate portion does not support the lead wires, the plate portion has a first surface and a second surface that is opposite from the first surface, the first surface faces a side of the lead-wire outlet portion and the lead wires are located on the second surface, the plate portion is configured such that a shape thereof is maintained in a normal state, in which an external force to bend the supporting member to the side of the lead-wire outlet portion is not applied to an end portion of the supporting member, and that the supporting member is bent with the first surface facing inwardly when the external force is applied to the supporting member, and the plate portion has a trench on at least one of the first surface and the second surface for increasing flexibility of the plate portion.

3. The injector according to claim 2, wherein the trench includes a plurality of trench portions, the plate portion has the plurality of trench portions on the first surface, and the second surface is a flat surface.

4. The injector according to claim 3, wherein each of the plurality of trench portions has an inverted triangle shape having an acute bottom, and the plurality of trench portions extend in a direction perpendicular to a longitudinal direction of the lead wires.

5. An injector comprising:

a cylindrical injector body having therein a housing opening;

an actuator housed in the housing opening;

two feeding lead wires. one ends of which being electrically connected to the actuator;

a nozzle configured to open and close in accordance with an energization state of the actuator and to inject a fuel when the nozzle is opened;

a lead-wire outlet portion that opens on a side surface of the injector body;

a communication hole that is provided in the injector body, the lead-wire outlet portion communicating with the housing opening via the communication hole; and a supporting member that is fixed to the actuator and supports the lead wires, wherein the housing opening extends straight from an end of the injector body at a side of the nozzle toward an opposite side of the nozzle, the communication hole extends in a direction bent by a predetermined angle with respect to an extending direction of the housing opening, the supporting member is configured to guide the other ends of the lead wires to the lead-wire outlet portion when the actuator is inserted into the housing opening, the supporting member includes a lead-wire supporting portion and a plate portion formed integrally with the lead-wire supporting portion, the lead-wire supporting portion directly supports the other ends of the lead wires and the plate portion does not support the lead wires, the plate portion has a first surface and a second surface that is opposite from the first surface, the first surface faces a side of the lead-wire outlet portion and the lead wires are located on the second surface, the plate portion is configured such that a shape thereof is maintained in a normal state, in which an external force to bend the supporting member to the side of the lead-wire outlet portion is not applied to an end portion of the supporting member, and that the supporting member is bent with the first surface facing inwardly when the external force is applied to the supporting member, and a dimension of the plate portion in a longitudinal direction of the lead wires is larger than that of the communication hole.

* * * * *